US006111348A

United States Patent [19]

Horne et al.

[11] Patent Number: 6,111,348

[45] Date of Patent: Aug. 29, 2000

[54] COLOR DISPLAY DEVICE COMPRISING A SADDLE-SHAPED COLOR SELECTION ELECTRODE

[75] Inventors: Remko Horne; Albertus A. S. Sluyterman; Berend J. W. Ter Weeme; Augustinus H. M. Boshouwers, all of Eindhoven, Netherlands

[73] Assignee: U.S. Philips Corporation, New York, N.Y.

[21] Appl. No.: 09/251,235

[22] Filed: Feb. 16, 1999

[30] Foreign Application Priority Data

Feb. 16, 1998 [EP] European Pat. Off. ..... 98200477

[51] Int. Cl.[7] ..... H01J 29/80

[52] U.S. Cl. ..... 313/402; 313/403; 313/6

[58] Field of Search ..... 313/402, 403, 313/408, 409, 414, 415, 416, 477 R, 2.1, 3, 5, 6

[56] References Cited

U.S. PATENT DOCUMENTS 4,280,077 7/1981 Villanyi ..... 313/402
5,276,377 1/1994 Van Nes et al. ..... 313/477 R

*Primary Examiner*—Frank G. Font
*Assistant Examiner*—Roy M. Punnoose
*Attorney, Agent, or Firm*—John C. Fox

[57] ABSTRACT

A color cathode ray tube is provided with a saddle-shaped shadow mask.

As a result, the sensitivity to doming and microphonics of the mask is improved. This is advantageous, in particular, for a cathode ray tube having a very flat display window. Preferably, the display device in which the cathode ray tube is employed is provided with two dynamic quadrupoles, for example, in front of the electron gun and in front of a deflection unit.

4 Claims, 3 Drawing Sheets

COLOR DISPLAY DEVICE COMPRISING A SADDLE-SHAPED COLOR SELECTION ELECTRODE

BACKGROUND OF THE INVENTION

The invention relates to a color display device comprising a color cathode ray tube including an in-line electron gun for generating three electron beams, a color selection electrode and a phosphor screen on an inner surface of a display window and a means for deflecting the electron beams across the color selection electrode.

Such color display devices are known.

The trend is towards display windows having a flatter outer surface, so that the image displayed by the color display device is perceived as being flat. However, as the radius of curvature of the outer surface increases, a number of problems increase accordingly. The radius of curvature of the inner surface of the display window and of the color selection electrode should increase too, and as the color selection electrode becomes flatter, the strength of said color selection electrode decreases and hence the sensitivity to doming and vibrations increases. Particularly the sensitivity of the color selection electrode to the so-called drop-test increases. An alternative would be to give the inner surface of the display window a greater curvature than the outer surface. This would enable the use of a color selection electrode with a relatively small radius of curvature. This reduces the doming and vibration problems, but it leads to other problems. The thickness of the display window in the center is much smaller than at the edges. As a result, the weight of the display window increases and the intensity of the image decreases substantially towards the edges.

OBJECTS AND SUMMARY OF THE INVENTION

It is an object of the invention to provide a color cathode ray tube of the type mentioned in the opening paragraph, in which the outer surface may be flat or substantially flat, while the above problems are reduced or obviated.

To achieve this, a color display device in accordance with the invention is characterized in that the color selection electrode is saddle-shaped and the color display device comprises a means for dynamically influencing the paths of the electron beams.

The color display device in accordance with the invention comprises a saddle-shaped color selection electrode, that is a color selection electrode whose radii of curvature in two mutually perpendicular directions through a center of the color selection electrode are of opposite sign. The color display device further includes a means for dynamically, that is as a function of the deflection, influencing the convergence of the electron beams on the display screen. The saddle shape of the color selection electrode provides for a small sensitivity to vibrations (microphonics) and a small sensitivity to doming, and, in particular, the color selection electrode is much stronger as regards the drop-test. The saddle shape of the color selection electrode influences the distance between the color selection electrode and the display screen. When the convergence of the electron beams remains constant, changes of this distance may cause picture errors. The means for dynamically influencing the distance between and the convergence of the electron beams, i.e. influencing as a function of the deflection, which means as a function of the position of the electron beams on the color selection electrode, enables the paths of the electron beams to be influenced such that picture errors are reduced or precluded. Preferably, the color selection electrode is curved towards the display window along an axis corresponding to the frame deflection axis, and the means includes a means for influencing the paths of electron beams as a function of the frame deflection.

Preferably, the color selection electrode comprises ridges, corrugations or grooves. This causes the sturdiness of the color selection electrode to be further increased.

These and other aspects of the invention will be apparent from and elucidated with reference to the embodiments described hereinafter.

BRIEF DESCRIPTION OF THE INVENTION

Figure 4:
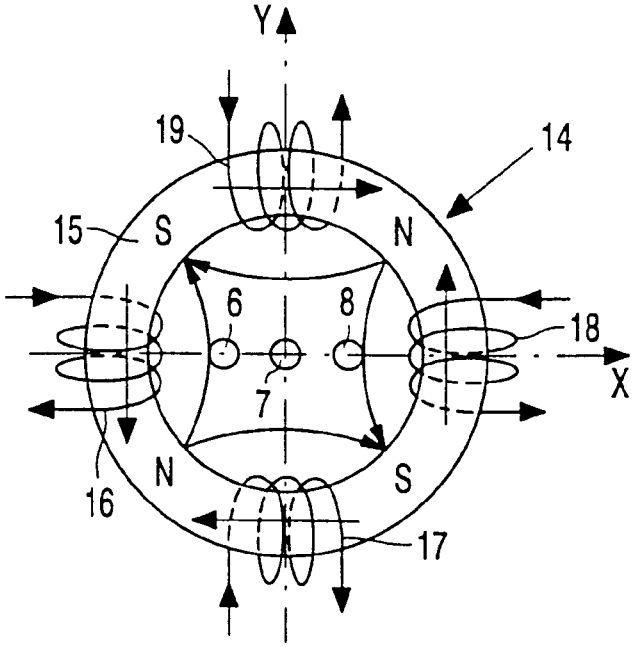

FIG. 4 schematically shows a quadrupole element.

The Figures are not drawn to scale. In the Figures, like reference numerals generally refer to like parts.

DESCRIPTION OF THE PREFERRED EMBODIMENTS

The display device comprises a cathode ray tube, in this example a color display tube, which comprises an evacuated envelope 1 which includes a display window 2, a cone portion 3 and a neck 4. Said neck 4 accommodates an electron gun 5 for generating three electron beams 6, 7 and 8 which are situated in one plane, the in-line plane, which in this case is the plane of the drawing. In the undeflected state, the central electron beam 7 coincides substantially with the tube axis 9. A display screen 10 is situated on the inner surface of the display window. Said display screen 10 comprises a large number of phosphor elements luminescing in red, green and blue. On their way to the display screen, the electron beams are deflected across the display screen 10 by means of an electromagnetic deflection unit 51 and pass a color selection electrode 11 which is arranged in front of the display window 2 and which includes a thin plate having apertures 12. The three electron beams 6, 7 and 8 pass through the aperture 12 of the color selection electrode at a small angle with respect to each other and, consequently, each electron beam impinges only on phosphor elements of one color. The color selection electrode is saddle-shaped, as shown in more detail in FIGS. 2A through 2C. The deflection unit 51 comprises, apart from a coil holder 13, coils 13' for deflecting the electron beams in two mutually perpendicular directions. The display device further includes means for generating voltages which are supplied, during operation, to parts of the electron gun via feedthroughs. The deflection plane 20 is schematically shown as well as the distance p between the electron beams 6 and 8 in this plane and the distance q between the color selection electrode and the display screen.

Figure 2A:
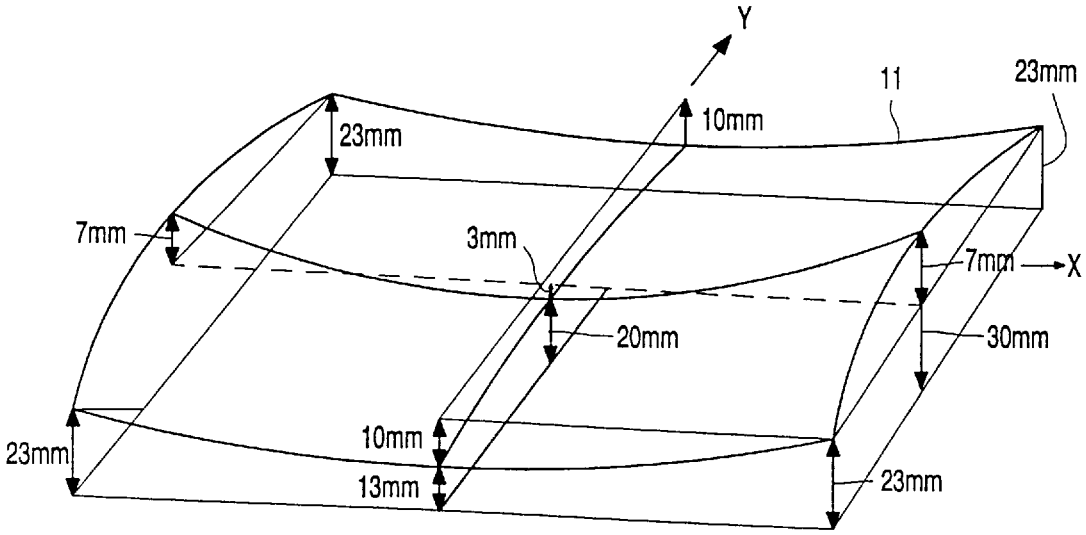
FIG. 2A is a sectional view of a color selection electrode for a display device in accordance with the invention.
Figure 2B:
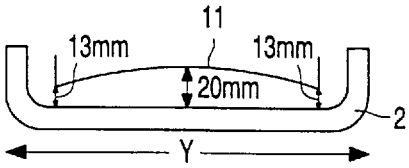
FIGS. 2B and 2C show the position of the color selection electrode relative to the display window.
Figure 2C:
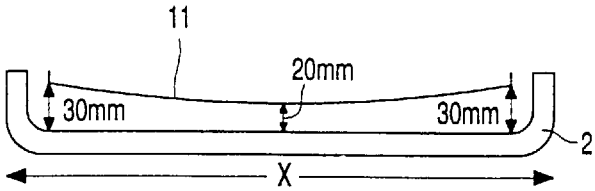

FIG. 2A is a partly perspective view of a color selection electrode 11 for a color display device in accordance with the invention. The color selection electrode 11 is saddle-shaped, i.e. the curvatures are of opposite sign along the axes of symmetry through the center (the x-axis and y-axis). FIG. 2B shows that, along the short axis (the y-axis), the color selection electrode curves towards the display window, while, along the long axis, the color selection electrode curves away from the display window. The saddle shape ensures that the color selection electrode is very strong. As a result, microphonics and doming problems are reduced. A few values of distances between the inner surface of the display window and the color selection electrode are indicated. These values only serve as examples and should not be construed in a limiting sense.

The distance between the inner surface of the display window and the color selection electrode exhibits a large variation. This variation may cause picture errors. To preclude, or reduce, the occurrence of errors in the image, the color display device comprises a means for dynamically influencing the paths of the electron beams. This can be achieved, for example, by making the apparent pitch of the gun increase as the electron beams are deflected by means of two 4-pole fields, one at the location of the electron gun and one at the location of the deflection unit. An additional advantage of the apparent increase of the pitch of the gun is the improvement of the spot quality of the electron beams as the beams are deflected.

Preferably, along the short axis (the frame-frequency axis), the color selection electrode is curved towards the display window and the means includes means for dynamically influencing the paths of the electron beams as a function of the frame deflection. This shape is more compatible with already known deflection fields and, in addition, driving the means is much simpler since it takes place by the frame frequency, which is lower than the line frequency.

A further improvement of the doming behavior of the color selection electrode is obtained by providing the color selection electrode with ridges. Preferably, said ridges extend transversely to the direction of the greatest radius of curvature.

Figure 3:
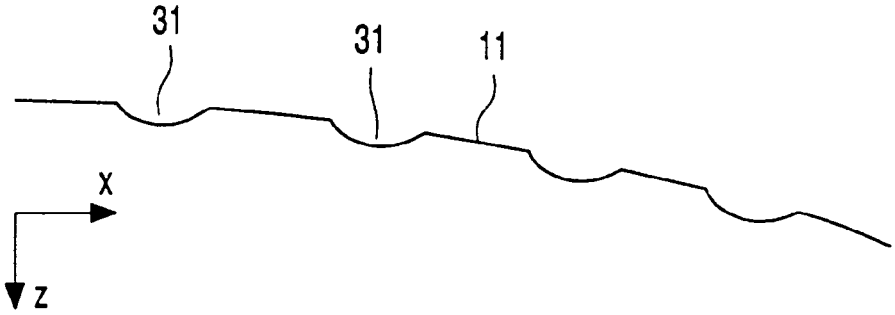
FIG. 3 is a sectional view of a further embodiment of a color selection electrode.

FIG. 3 is a sectional view of a color selection electrode 11 with ridges 31.

Figure 1:
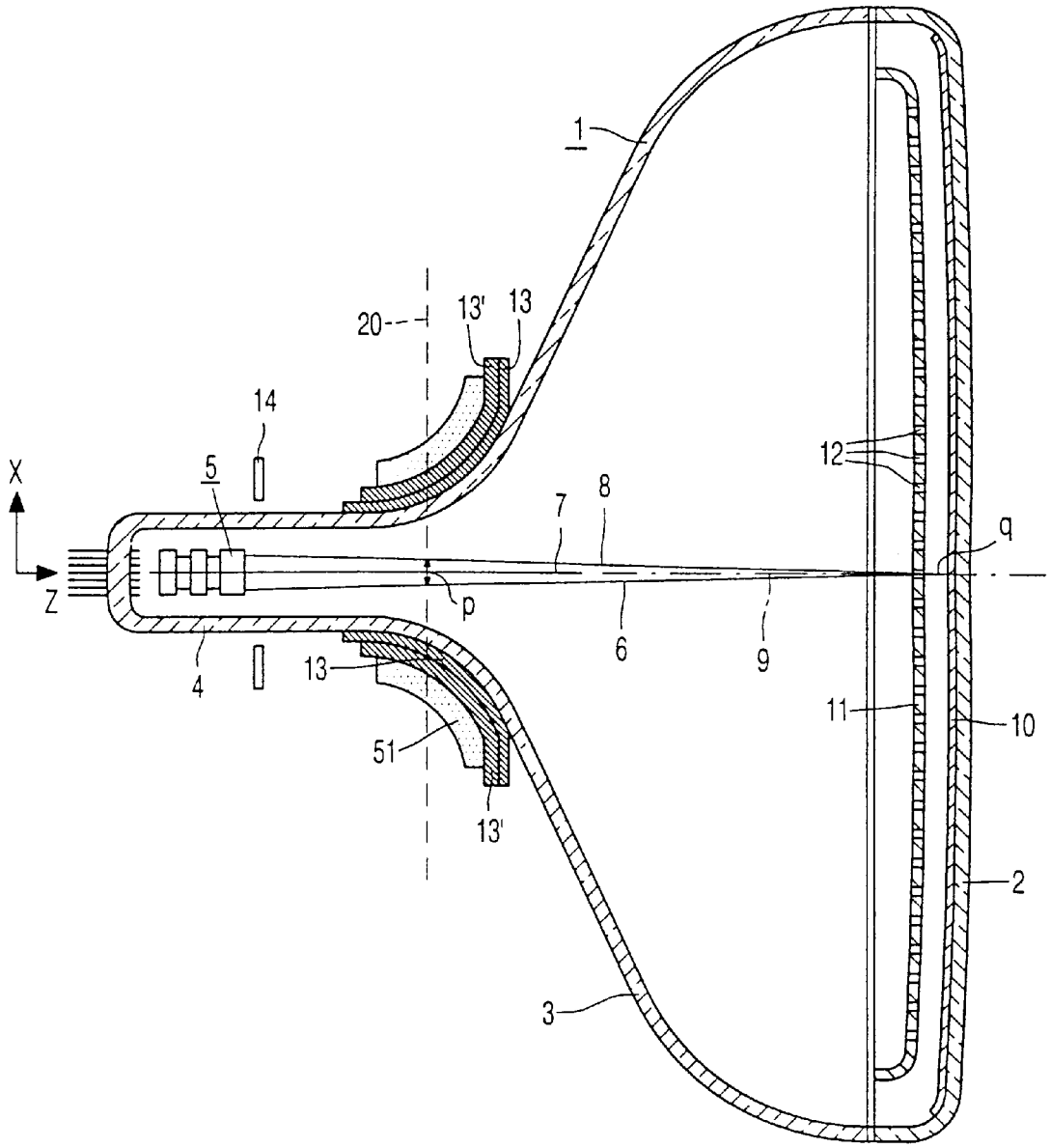
FIG. 1 is a sectional view of a display device in which the invention is schematically indicated.

The color display device includes a means 14 (see FIG. 1) for dynamically influencing, during operation, the paths of the electron beams. FIG. 4 shows an example of such a means. In this example, the means comprises a ring core of a magnetizable material on which four coils 16, 17, 18 and 19 are wound such that, upon energizing, a 45° 4-pole field is generated. By means of this field, the paths of the electron beams are dynamically influenced.

It will be obvious that within the scope of the invention many variations are possible.

What is claimed is:

1. A color display device comprising a color cathode ray tube including an in-line electron gun for generating three electron beams, a color selection electrode and a phosphor screen on an inner surface of a display window and a means for deflecting the electron beams across the color selection electrode, characterized in that the color selection electrode is saddle-shaped and the color display device comprises a means for dynamically influencing the paths of the electron beams.

2. A color display device as claimed in claim 1, characterized in that the color selection electrode is curved towards the display window along an axis corresponding to the image deflection axis, and the means includes a means for influencing the paths of electron beams as a function of the frame deflection.

3. A color display device as claimed in claim 1, characterized in that the color selection electrode comprises ridges, corrugations or grooves.

4. A color display device as claimed in claim 1, characterized in that the means includes a means for generating a dynamic quadrupole field.

* * * * *